US007352264B2

(12) United States Patent
Schwab et al.

(10) Patent No.: US 7,352,264 B2
(45) Date of Patent: Apr. 1, 2008

(54) ELECTRONICALLY TUNABLE DIELECTRIC RESONATOR CIRCUITS

(75) Inventors: Paul John Schwab, Nashua, NH (US); Kristi Dhimiter Pance, Auburndale, MA (US); Neil James Craig, Nashua, NH (US)

(73) Assignee: M/A-COM, Inc., Lowell, MA (US)

( * ) Notice: Subject to any disclaimer, the term of this patent is extended or adjusted under 35 U.S.C. 154(b) by 200 days.

(21) Appl. No.: 11/257,371

(22) Filed: Oct. 24, 2005

(65) Prior Publication Data

US 2007/0090899 A1 Apr. 26, 2007

(51) Int. Cl.
*H01P 7/10* (2006.01)
*H01P 1/20* (2006.01)

(52) U.S. Cl. ..... 333/203; 333/219.1; 333/223; 333/235

(58) Field of Classification Search ..... 333/205, 333/207, 202, 219.1, 223, 231, 235
See application file for complete search history.

(56) References Cited

U.S. PATENT DOCUMENTS

| | | | | |
|---|---|---|---|---|
| 3,475,642 | A | 10/1969 | Karp et al. | 315/3.5 |
| 4,028,652 | A | 6/1977 | Wakino et al. | 333/73 W |
| 4,138,652 | A | 2/1979 | Nishikawa et al. | 333/82 R |
| 4,267,537 | A | 5/1981 | Karmel | 333/231 |
| 4,283,649 | A | 8/1981 | Heinouchi | 310/324 |
| 4,423,397 | A | 12/1983 | Nishikawa et al. | 333/202 |
| 4,459,570 | A | 7/1984 | Delaballe et al. | 333/202 |
| 4,459,571 | A | 7/1984 | Fraser | |
| 4,477,785 | A | 10/1984 | Atia | 333/202 |
| 4,578,655 | A | 3/1986 | Etienne et al. | 333/202 |
| 4,620,168 | A | 10/1986 | Delestre et al. | 333/202 |
| 4,661,790 | A | 4/1987 | Gannon et al. | 333/234 |
| 4,757,289 | A | 7/1988 | Kosugi et al. | 333/209 |
| 4,810,984 | A | 3/1989 | Arnold et al. | 333/202 |
| 4,821,006 | A | 4/1989 | Ishikawa et al. | 333/202 |
| 4,835,498 | A | 5/1989 | Rouger et al. | |
| 4,881,051 | A | 11/1989 | Tang et al. | 333/208 |
| 5,059,929 | A | 10/1991 | Tanaka | 333/219.1 |

(Continued)

FOREIGN PATENT DOCUMENTS

EP 0 296 009 A1 12/1988

(Continued)

OTHER PUBLICATIONS

M. A. Gerdine, "A Frequency-Stabilized Microwave Band-Rejection Filter Using High Dielectric Constant Resonators", IEEE Transactions on Microwave Theory and Techniques, vol. MTT-17, No. 7, Jul. 1969, pp. 354-359.

(Continued)

*Primary Examiner*—Stephen E. Jones

(57) ABSTRACT

In order to permit electronic tuning of the frequency of a circuit including dielectric resonators, such as a dielectric resonator filter, tuning plates are employed adjacent the individual dielectric resonators. The tuning plates comprises two separate conductive portions and an electronically tunable element electrically coupled therebetween. The electronically tunable element can be any electronic component that will permit changing the capacitance between the two separate conductive portions of the tuning plates by altering the current or voltage supplied to the electronically tunable element. Such components include virtually any two or three terminal semiconductor device. However, preferable devices include varactor diodes and PIN diodes.

21 Claims, 7 Drawing Sheets

U.S. PATENT DOCUMENTS

| | | | | |
|---|---|---|---|---|
| 5,109,207 | A | 4/1992 | Aizawa et al. | 333/222 |
| 5,140,285 | A | 8/1992 | Cohen | 331/96 |
| 5,218,330 | A | 6/1993 | Omiya et al. | 333/223 |
| 5,347,246 | A | 9/1994 | Bellows et al. | 333/219 |
| 5,525,945 | A | 6/1996 | Chiappetta et al. | 333/202 |
| 5,614,875 | A | 3/1997 | Jang et al. | 333/202 |
| 5,691,677 | A | 11/1997 | De Maron et al. | 333/219.1 |
| 5,748,058 | A | 5/1998 | Scott | 333/202 |
| 5,777,534 | A | 7/1998 | Harrison | 333/202 |
| 5,841,330 | A | 11/1998 | Wenzel et al. | 333/202 |
| 5,859,574 | A | 1/1999 | Schmitt | 333/202 |
| 5,942,950 | A * | 8/1999 | Merenda | 331/99 |
| 5,949,309 | A | 9/1999 | Correa | 333/202 |
| 5,990,767 | A | 11/1999 | Ivanov et al. | 333/219.1 |
| 6,087,910 | A | 7/2000 | Matsumoto et al. | 333/202 |
| 6,100,703 | A | 8/2000 | Davidov et al. | 324/631 |
| 6,111,339 | A | 8/2000 | Ohya et al. | 310/358 |
| 6,208,227 | B1 | 3/2001 | Remillard et al. | 333/219 |
| 6,254,708 | B1 | 7/2001 | Cappabianca | 156/89.12 |
| 6,262,639 | B1 | 7/2001 | Shu et al. | 333/202 |
| 6,337,664 | B1 | 1/2002 | Mayes et al. | 343/749 |
| 6,402,981 | B1 | 6/2002 | Sasaki | 252/62.9 PZ |
| 6,707,353 | B1 | 3/2004 | Yamakawa et al. | 333/202 |
| 6,717,490 | B1 | 4/2004 | Mayer | 333/202 |
| 6,784,768 | B1 | 8/2004 | Pance et al. | 333/219 |
| 2003/0210109 | A1 | 11/2003 | Zhu et al. | |
| 2004/0051602 | A1 | 3/2004 | Pance et al. | |
| 2004/0051603 | A1 | 3/2004 | Pance et al. | 333/202 |

FOREIGN PATENT DOCUMENTS

| | | | |
|---|---|---|---|
| EP | 0 492 304 | A1 | 7/1992 |
| EP | 0 601 370 | A1 | 6/1994 |
| EP | 1 162 684 | A3 | 12/2001 |
| EP | 1 181 740 | B1 | 3/2003 |
| GB | 1 376 938 | | 12/1974 |
| GB | 1 520 473 | | 8/1978 |
| JP | 57-014202 | A | 1/1982 |
| JP | 59-202701 | | 11/1984 |
| JP | 363280503 | A | 11/1988 |
| JP | 01-144701 | | 6/1989 |
| JP | 02-042898 | A | 2/1990 |
| JP | 02-137502 | | 5/1990 |
| JP | 02-168702 | | 6/1990 |
| JP | 05-102714 | | 4/1993 |
| JP | 05-267940 | | 10/1993 |
| JP | 06-061714 | | 3/1994 |
| JP | 07-154114 | A | 6/1995 |
| JP | 07-154116 | | 6/1995 |
| JP | 03-249803 | | 9/2003 |
| WO | WO 00/70706 | | 11/2000 |
| WO | WO 01/43221 | | 6/2001 |
| WO | WO 02/49142 | | 6/2002 |
| WO | WO 2004/027917 | | 4/2004 |

OTHER PUBLICATIONS

S. Verdeyme & P. Guillon "New Direct Coupling Configuration Between $TE_{01\sigma}$ Dielectric Resonator Modes" Electronics Letters, 25th May 1989, vol. 25 No. 11, pp. 693-694.

T. Nishikawa et al., "Dielectric High-Power Bandpass Filter Using Quarter-Cut $TE_{01\sigma}$ Image Resonator for Cellular Base Stations", IEEE Transactions on Microwave Theory and Techniques, vol. MTT-35, No. 12, Dec. 1987, pp. 1150-1155.

Hui et al. "Dielectric Ring-Gap Resonator for Application in MMIC's" IEEE Transactions on Microwave Theory and Techniques vol. 39, No. 12, Nov. 1991.

D. Kajfez and P. Guillon "Dielectric Resonators", ISBN 0-89006-201-3, Publisher Artech House, Dedham, MA 1986, pp. 298-317.

E. J. Heller, "Quantum Proximity Resonances", Physical Review Letters, vol. 77, No. 20, Nov. 11, 1966 The American Physical Society, pp. 4122-4125.

K. Pance et al., "Tunneling Proximity Resonances: Interplay Between Symmetry and Dissipation", Physics Department, Northwestern University Aug. 2, 1999, T-143, pp. 16-18, F426.

Kishk et al., "Conical Dielectric Resonator Antennas for Wide-Band Applications," IEEE Transactions on Antennas and Propogation 50(4); 469-474 (2002).

* cited by examiner

ELECTRONICALLY TUNABLE DIELECTRIC RESONATOR CIRCUITS

FIELD OF THE INVENTION

The invention pertains to dielectric resonator and combline circuits and, particularly, dielectric resonator and combline filters. More particularly, the invention pertains to techniques for frequency tuning such circuits.

BACKGROUND OF THE INVENTION

Dielectric resonators are used in many circuits for concentrating electric fields. They are commonly used as filters in high frequency wireless communication systems, such as satellite and cellular communication applications. They can be used to form oscillators, triplexers and other circuits, in addition to filters. Combline filters are another well known type of circuit used in front-end transmit/receive filters and diplexers of communication systems such as Personal Communication System (PCS), and Global System for Mobile communications (GSM). The combline filters are configured to pass only certain frequency bands of electromagnetic waves as needed by the communication systems.

FIG. 1 is a perspective view of a typical dielectric resonator of the prior art. As can be seen, the resonator 10 is formed as a cylinder 12 of dielectric material with a circular, longitudinal through hole 14. FIG. 2A is a perspective view of a microwave dielectric resonator filter 20 of the prior art employing a plurality of dielectric resonators 10. The resonators 10 are arranged in the cavity 22 of a conductive enclosure 24. The conductive enclosure 24 typically is rectangular. The enclosure 24 commonly is formed of aluminum and is silver-plated, but other materials also are well known. The resonators 10 may be attached to the floor of the enclosure, such as by an adhesive, but also may be suspended above the floor of the enclosure by a low-loss dielectric support, such as a post or rod.

Microwave energy is introduced into the cavity by an input coupler 28 coupled to an input energy source through a conductive medium, such as a coaxial cable. That energy is electromagnetically coupled between the input coupler and the first dielectric resonator. Coupling may be electric, magnetic or both. Conductive separating walls 32 separate the resonators from each other and block (partially or wholly) coupling between physically adjacent resonators 10. Particularly, irises 30 in walls 32 control the coupling between adjacent resonators 10. Walls without irises generally prevent any coupling between adjacent resonators separated by those walls. Walls with irises allow some coupling between adjacent resonators separated by those walls. By way of example, the dielectric resonators 10 in FIG. 2 electromagnetically couple to each other sequentially, i.e., the energy from input coupler 28 couples into resonator 10*a*, resonator 10*a* couples with the sequentially next resonator 10*b* through iris 30*a*, resonator 10*b* couples with the sequentially next resonator 10*c* through iris 30*b*, and so on until the energy is coupled from the sequentially last resonator 10*d* to the output coupler 40. Wall 32*a*, which does not have an iris, prevents the field of resonator 10*a* from coupling with physically adjacent, but not sequentially adjacent, resonator 10*d* on the other side of the wall 32*a*. Dielectric resonator circuits are known in which cross coupling between non-sequentially adjacent resonators is desirable and is, therefore, allowed and/or caused to occur. However, cross-coupling is not illustrated in the exemplary dielectric resonator filter circuit shown in FIG. 2A.

An output coupler 40 is positioned adjacent the last resonator 10*d* to couple the microwave energy out of the filter 20. Signals also may be coupled into and out of a dielectric resonator circuit by other techniques, such as microstrips positioned on the bottom surface 44 of the enclosure 24 adjacent the resonators.

Generally, both the bandwidth and the center frequency of the filter must be set very precisely. Bandwidth is dictated by the coupling between the electrically adjacent dielectric resonators and, therefore, is primarily a function of (a) the spacing between the individual dielectric resonators 10 of the circuit and (b) the metal between the dielectric resonators (i.e., the size and shape of the housing 24, the walls 32 and the irises 30 in those walls, as well as any tuning screws placed between the dielectric resonators as discussed below). Frequency, on the other hand, is primarily a function of the characteristics of the individual dielectric resonators themselves, such as the size of the individual dielectric resonators and the metal adjacent the individual resonators (i.e., the housing and the tuning plates 42 discussed immediately below).

Initial frequency and bandwidth tuning of these circuits is done by selecting a particular size and shape for the housing and the spacing between the individual resonators. This is a very difficult process that is largely performed by those in the industry empirically by trial and error. Accordingly, it can be extremely laborious and costly. Particularly, each iteration of the trial and error process requires that the filter circuit be returned to a machine shop for re-machining of the cavity, irises, and/or tuning elements (e.g., tuning plates and tuning screws) to new dimensions. In addition, the tuning process involves very small and/or precise adjustments in the sizes and shapes of the housing, irises, tuning plates and cavity. Thus, the machining process itself is expensive and error-prone.

Furthermore, generally, a different housing design must be developed and manufactured for every circuit having a different frequency. Once the housing and initial design of the circuit is established, then it is often necessary or desirable to provide the capability to perform fine tuning of the frequency.

Furthermore, the walls within which the irises are formed, the tuning plates, and even the cavity all create losses to the system, decreasing the quality factor, Q, of the system and increasing the insertion loss of the system. Q essentially is an efficiency rating of the system and, more particularly, is the ratio of stored energy to lost energy in the system. The portions of the fields generated by the dielectric resonators that exist outside of the dielectric resonators touch all of the conductive components of the system, such as the enclosure 20, tuning plates 42, and internal walls 32 and 34, and inherently generate currents in those conductive elements. Field singularities exist at any sharp corners or edges of conductive components that exist in the electromagnetic fields of the filter. Any such singularities increase the insertion loss of the system, i.e., reduces the Q of the system. Thus, while the iris walls and tuning plates are necessary for tuning, they are the cause of loss of energy within the system.

In order to permit fine tuning of the frequency of such circuits after the basic design is developed, one or more metal tuning plates 42 may be attached to a top cover plate (the top cover plate is not shown in FIG. 2) generally coaxially with a corresponding resonator 10 to affect the field of the resonator (and particularly the parasitic capacitance experienced by the resonator) in order to help set the center frequency of the filter. Particularly, plate 42 may be mounted on a screw 43 passing through a threaded hole in the top cover plate (not shown) of enclosure 24. The screw may be rotated to vary the distance between the plate 42 and the resonator 10 to adjust the center frequency of the resonator.

This is a purely mechanical process that also tends to be performed by trial and error, i.e., by moving the tuning plates and then measuring the frequency of the circuit. This process also can be extremely laborious since each individual dielectric resonator and accompanying tuning plate must be individually adjusted and the resulting response measured.

Means also often are provided to fine tune the bandwidth of a dielectric resonator circuit after the basic design has been selected. Such mechanisms often comprise tuning screws positioned in the irises between the adjacent resonators to affect the coupling between the resonators. The tuning screws can be rotated within threaded holes in the housing to increase or decrease the amount of conductor (e.g., metal) between adjacent resonators in order to affect the capacitance between the two adjacent resonators and, therefore, the coupling therebetween.

A disadvantage of the use of tuning screws within the irises is that such a technique does not permit significant changes in coupling strength between the dielectric resonators. Tuning screws typically provide tunability of not much more than 1 or 2 percent change in bandwidth in a typical communication application, where the bandwidth of the signal is commonly about 1 percent of the carrier frequency. For example, it is not uncommon in a wireless communication system to have a 20 MHz bandwidth signal carried on a 2000 MHz carrier. It would be very difficult using tuning screws to adjust the bandwidth of the signal to much greater than 21 or 22 MHz.

As is well known in the art, dielectric resonators and dielectric resonator filters have multiple modes of electrical fields and magnetic fields concentrated at different center frequencies. A mode is a field configuration corresponding to a resonant frequency of the system as determined by Maxwell's equations. In a dielectric resonator, the fundamental resonant mode frequency, i.e., the lowest frequency, is normally the transverse electric field mode, $TE_{01}$ (or TE hereinafter). Typically, the fundamental TE mode is the desired mode of the circuit or system in which the resonator is incorporated. The second-lowest-frequency mode typically is the hybrid mode, $H_{11}$ (or $H_{11}$ hereinafter). The $H_{11}$ mode is excited from the dielectric resonator, but a considerable amount of electric field lies outside of the resonator and, therefore, is strongly affected by the cavity. The $H_{11}$ mode is the result of an interaction of the dielectric resonator and the cavity within which it is positioned (i.e., the enclosure) and has two polarizations. The $H_{11}$ mode field is orthogonal to the TE mode field. Some dielectric resonator circuits are designed so that the $H_{11}$ mode is the fundamental mode. For instance, in dual mode filters, in which there are two signals at different frequencies, it is known to utilize the two polarizations of the $H_{11}$ mode for the two signals.

There are additional higher order modes, including the $TM_{01}$ mode, but they are rarely, if ever, used and essentially constitute interference. Typically, all of the modes other than the TE mode (or $H_{11}$ mode in filters that utilize that mode) are undesired and constitute interference.

FIG. 2B is a perspective view of a conventional combline filter 100 (with a cover removed therefrom) having uniform resonator rods. As shown in FIG. 2B, the combline filter 100 includes a plurality of uniform resonator rods 106 disposed within a metal housing 102, input and output terminals 112 and 114 disposed on the outer surface of the metal housing 102, and loops 116 and 116 for inductively coupling electromagnetic signals to and from the input and output terminals 112 and 114. The metal housing 102 is provided with a plurality of cavities 104 separated by dividing walls 104*a*. Certain dividing walls 104*a* have a well-known structure called a decoupling "iris" 108 defining an opening in the wall. A dividing wall 104*a* a having an iris 108 is used to control the amount of coupling between two adjacent resonator rods 106, which controls the bandwidth of the filter. The resonator rods 106 vibrate or resonate at particular frequencies to filter or selectively pass certain frequencies of signals inductively applied thereto. Particularly, input signals from the input terminal 112 of the combline filter 100 are inductively transmitted to the first resonator rod 106 through the first loop 116 and are filtered through the resonance of the resonator rods 106. The filtered signals are then output at the output terminal 114 of the combline filter 100 through second the loop 116.

In conventional combline filters, the passing frequency range of the filter can be selectively varied by changing the lengths or dimensions of the resonator rods. The operational bandwidth of the filter is selectively varied by changing the electromagnetic (EM) coupling coefficients between the resonator rods. The EM coupling coefficient represents the strength of EM coupling between two adjacent resonator rods and equals the difference between the magnetic coupling coefficient and the electric coupling coefficient between the two resonator rods. The magnetic coupling coefficient represents the magnetic coupling strength between the two resonator rods, whereas the electric coupling coefficient represents the electric coupling strength between the two resonator rods. Usually, the magnetic coupling coefficient is larger than the electric coupling coefficient.

To vary the EM coupling (i.e., EM coupling coefficient) between two resonator rods, the size of the iris opening disposed between the two resonator rods is varied. For instance, if the iris disposed between the two resonator rods has a large opening, then a high EM coupling between the two resonator rods is effected. This results in a wide bandwidth operation of the filter. In contrast, if the iris has a small opening, a low EM coupling between the resonator rods is effected, resulting in a narrow bandwidth operation of the filter.

To vary the frequency of the filter, tuning screws (not shown in FIG. 2*b*) can be positioned so that they extend into the hollow center of the resonator rods. Such tuning screws can be adjustably mounted to the housing, such as by a threaded coupling, so that they can be screwed in and out so that more or less of the screws are disposed into the resonator rods. This alters the capacitive loading of the resonator rods and thus changes their center frequencies. This technique is shown and discussed in more detail in connection with FIG. 7 below.

SUMMARY OF THE INVENTION

It is an object of the present invention to provide improved dielectric resonator and combline circuits.

It is another object of the present invention to provide improved dielectric resonator and combline filter circuits.

It is a further object of the present invention to provide improved mechanisms and techniques for tuning the center frequency of dielectric resonator and combline circuits.

It is yet another object of the present invention to provide improved mechanisms and techniques for tuning the frequency of dielectric resonator and combline circuits.

The invention provides a method and apparatus for electronically tuning a dielectric resonator or combline circuit, such as a filter. The technique reduces or eliminates the need to perform mechanical tuning operations to fine tune the frequency of the circuit. It also decreases the precision required for designing and manufacturing the housing and other physical components of the system.

In accordance with the principles of the present invention as applied to a dielectric resonator circuit, tuning plates are employed adjacent the individual dielectric resonators, the tuning plates comprising two separate conductive portions and an electronically tunable element electrically coupled therebetween. The electronically tunable element can be any electronic component that will permit changing the capacitance between the two separate conductive portions of the tuning plates by altering the current or voltage supplied to the electronically tunable element. Such components include virtually any two or three terminal semiconductor device. However, preferable devices include varactor diodes and PIN diodes. Other possible devices include FETs and other transistors.

The total capacitance between the resonator, on the one hand, and the housing and tuning plate, on the other hand, essentially dictates the frequency of the circuit The electronic tuning element can alter the total capacitance by virtue of its tuning.

DETAILED DESCRIPTION OF THE INVENTION

U.S. patent application Ser. No. 10/268,415, which is fully incorporated herein by reference, discloses new dielectric resonators as well as circuits using such resonators. One of the key features of the new resonators disclosed in the aforementioned patent application is that the field strength of the TE mode field outside of and adjacent the resonator varies along the longitudinal dimension of the resonator. As disclosed in the aforementioned patent application, a key feature of these new resonators that helps achieve this goal is that the cross-sectional area of the resonator measured parallel to the field lines of the TE mode varies along the longitude of the resonator, i.e., perpendicular to TE mode field lines. In preferred embodiments, the cross-section varies monotonically as a function of the longitudinal dimension of the resonator. In one particularly preferred embodiment, the resonator is conical. Even more preferably, the cone is a truncated cone. In other preferred embodiments, the resonator is a stepped cylinder, i.e., it comprises two (or more) coaxial cylindrical portions of different diameters.

The techniques in accordance with the present invention significantly reduce the precision required in designing an enclosure for a dielectric resonator filter or other circuit. They also significantly decrease or eliminate the need for tuning of the circuit by mechanical means, such as movable tuning plates and movable resonators. Even furthermore, the present invention reduces or eliminates the need for a different enclosure for every different circuit of a particular frequency and/or bandwidth. Using the principles of the present invention, a single basic enclosure can be electronically tuned to suit circuits for different frequencies and/or bandwidths.

Figure 1:
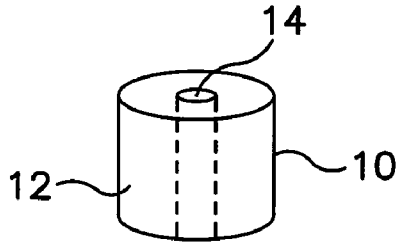
FIG. 1 PRIOR ART
FIG. 1 is a perspective view of a cylindrical dielectric resonator in accordance with the prior art.
Figure 2A:
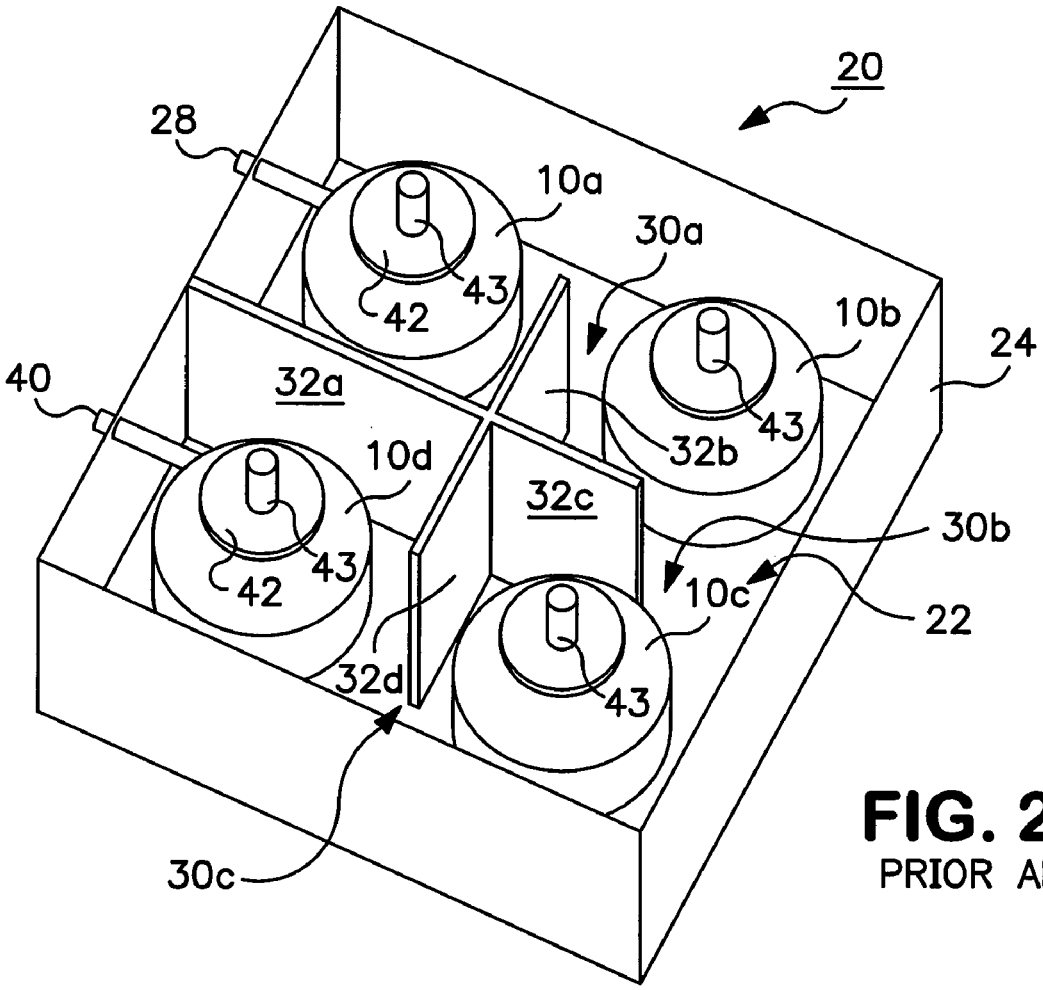
FIG. 2A PRIOR ART
FIG. 2A is a perspective view of an exemplary microwave dielectric resonator filter in accordance with the prior art.
Figure 2B:
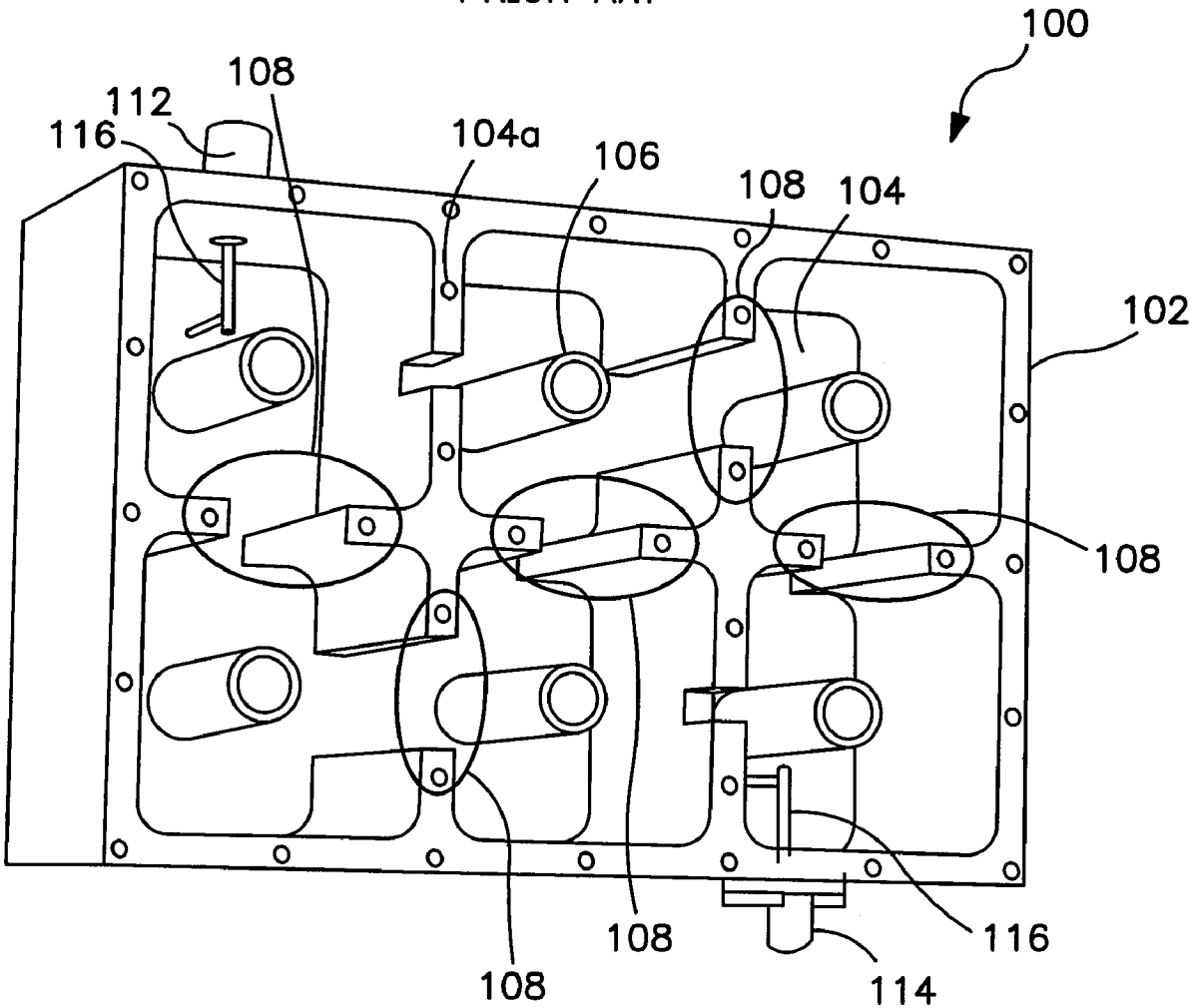
FIG. 2B PRIOR ART
FIG. 2B is a perspective view of an exemplary combline filter in accordance with the prior art.
Figure 3:
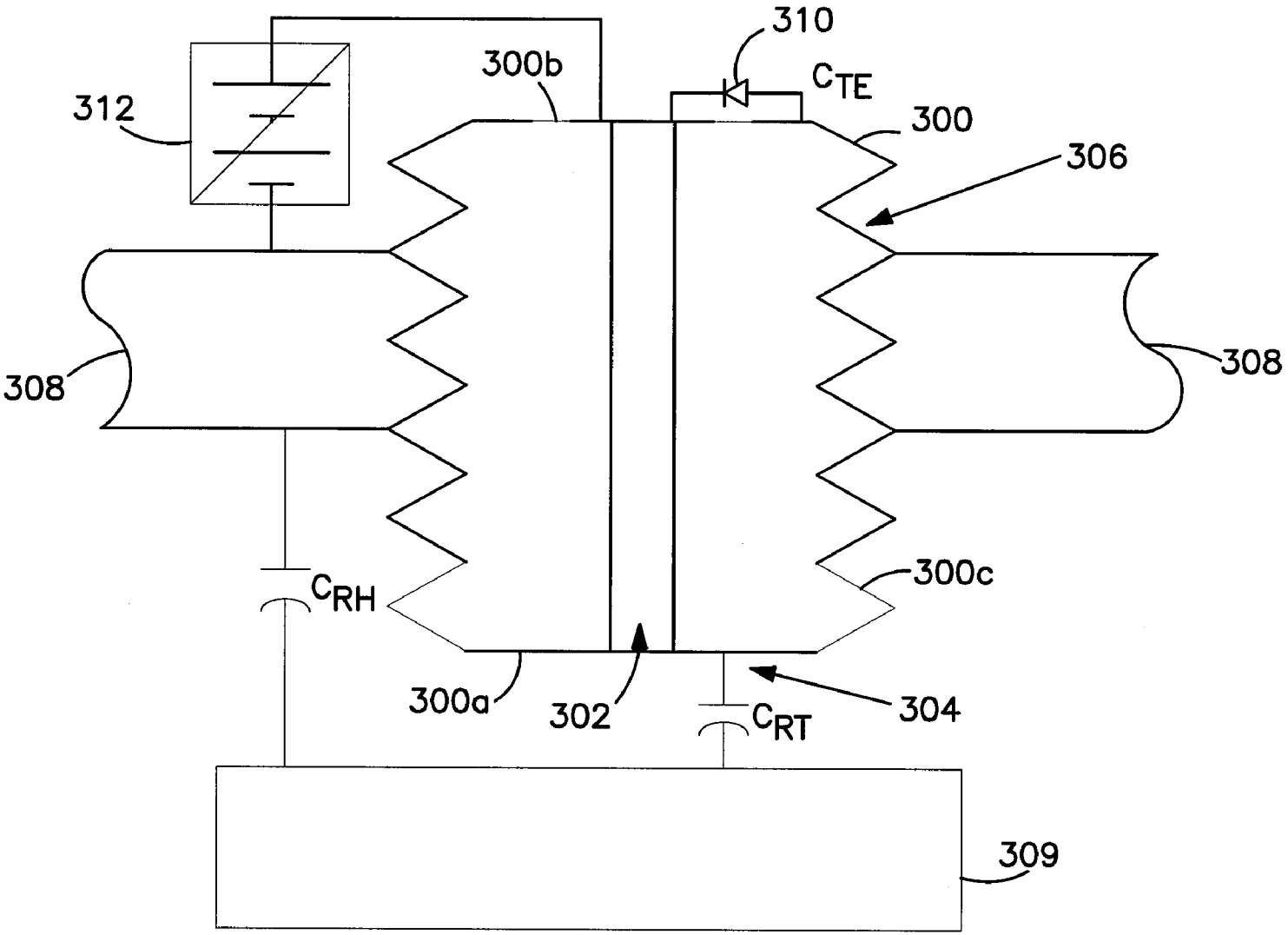
FIG. 3 is a cross-sectional view of a tuning plate in accordance with a first embodiment of the present invention.

FIG. 3 is a schematic drawing illustrating the basic principles of the present invention. In accordance with the invention, a tuning plate 300 is formed of a dielectric material, rather than a conductive material. The tuning plate can be formed of virtually any dielectric material, including plastics, ceramics, and other dielectric materials. One particularly suitable plastic is Ultem™, available from General Electric Co. of Schenectady, N.Y., USA. Ultem is known to have very similar temperature and stability characteristics to aluminum, material commonly used in the conventional art for tuning plates for dielectric resonator circuits. Accordingly, it can easily be substituted for an aluminum tuning plate in an existing design with a high degree of confidence that its mechanical properties are compatible with the existing design.

In a preferred embodiment, the plate or plug 300 includes a longitudinal through hole 302. The surface of the tuning plate 300 is plated with two discrete metallizations 304 and 306, i.e., two metallizations that are not in conductive contact with each other. The first metallization 304 covers at least the bottom surface 300*a* of the tuning plate 300. Preferably, it also runs continuously up through the through hole 302 so as to permit a terminal of the tuning element to be coupled to metallization 304 at or near the top surface of the tuning plate 300. In the particular embodiment illustrated in FIG. 3, the metallization 304 continues on to the central portion of the top surface of the plate essentially forming a small metal disk in the center of the top surface 300*b* of the tuning plate. The second metallization 306 should cover at the least the majority of the threaded circumferential side wall 300*c* of the plug 300, but not make contact with the first metallization 304. Accordingly, as shown, the last thread or so at the bottom of the plug is not plated.

Accordingly, first metallization 304 includes metal on the bottom surface 300*a* that forms one plate of a capacitor between the plug 300 and the dielectric resonator 309 that will be positioned just beneath it. The other metallization 306 makes contact with the housing 308. Accordingly, there will be a first capacitance $C_{RT}$ between the bottom surface of the tuning plate 300 and the dielectric resonator 309. There also will be a second capacitance $C_{TE}$ between the first metallization 304 and the second metallization 306. That second capacitance is made adjustable by coupling a tuning circuit 310 between the two metallizations 304 and 306.

The tuning element 310 can be anything whose capacitance can be adjusted electronically. Electronically adjustable as used herein encompasses anything for which the capacitance thereof can be adjusted by varying the voltage or current supplied to a terminal thereof. In a preferred embodiment of the invention, the tuning element is a varactor diode. Other suitable devices include PIN diodes, FET transistors, bipolar transistors, and tunable capacitor circuits. A varactor diode is particularly suitable because it is a simple two terminal device, the capacitance of which is adjustable by varying the voltage supplied to one of its terminals. Thus, in accordance with the invention, the two terminals of the tuning element 310 are coupled across the two metallizations 304 and 306. In addition, a variable voltage supply or current supply 312 is coupled between the housing 308 and one of the metallizations 304 (as illustrated in FIG. 3) or 306 in order to provide an electrical signal to the electronic tuning element 310. By varying the control voltage (or current) to the tuning element, the capacitance $C_{TE}$ between the two metallizations 304 and 306 is varied.

Since the center frequency of the circuit is dictated primarily by the total parasitic capacitance experienced by the individual dielectric resonators, $C_{TE}$ can be adjusted to adjust the center frequency of the circuit (adjusting the capacitance experienced by each dielectric resonator in the circuit).

In addition to $C_{RT}$ and $C_{TE}$, the total capacitance is also affected by the parasitic capacitance between the enclosure and the dielectric resonator, $C_{RH}$.

Figure 5:
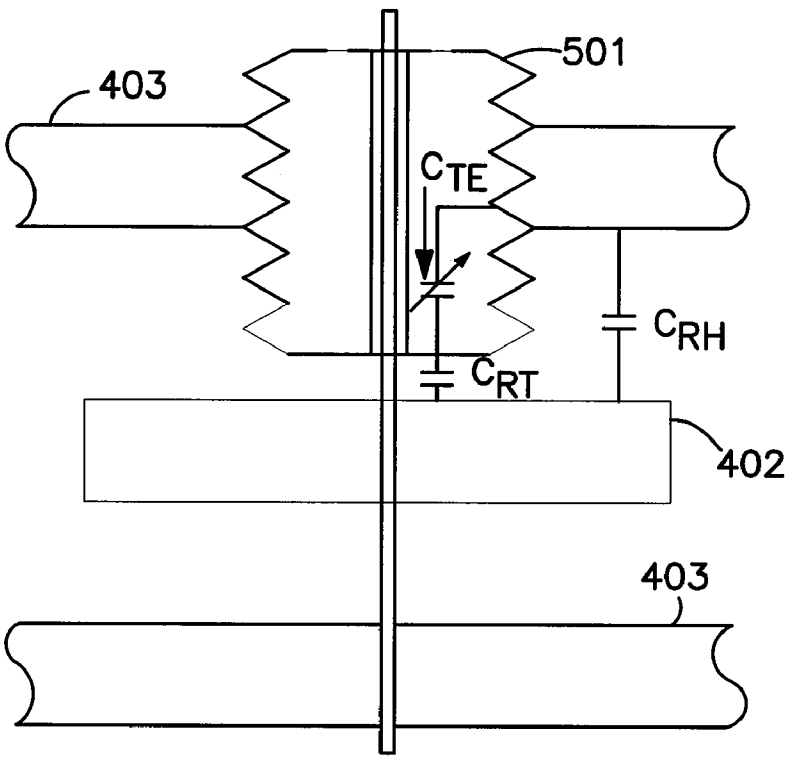
FIG. 5 is a schematic drawing illustrating the total capacitance between the DR and the housing/tuning plate in accordance with an embodiment of the present invention.
Figure 4:
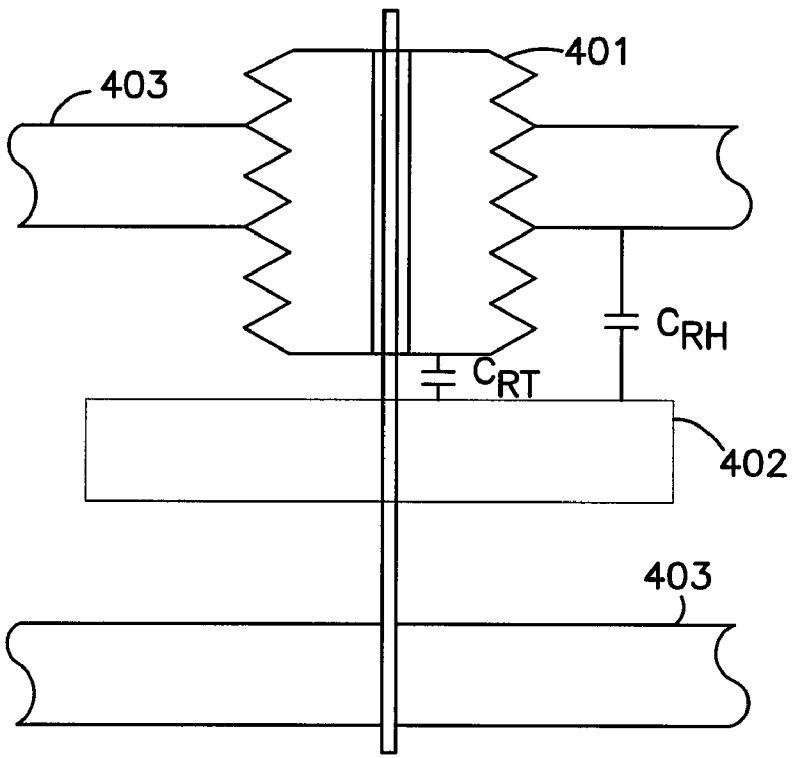
FIG. 4 PRIOR ART
FIG. 4 is a schematic drawing illustrating the total capacitance between the DR and the housing/tuning plate in accordance with the prior art.

With reference now to FIGS. 4 and 5, FIG. 4 illustrates the components of the total capacitance experienced by a single dielectric resonator in a conventional dielectric resonator circuit of the prior art while FIG. 5 illustrates the components of the total capacitance experienced by a single dielectric resonator in a dielectric resonator circuit in accordance with the present invention. As shown in FIG. 4, $C_{RT}$ represents the parasitic capacitance between the fully metal tuning plate 401 and a dielectric resonator 402. $C_{RH}$ represents the parasitic capacitance between the metal housing 403 and a dielectric resonator 402. Since $C_{RT}$ and $C_{RH}$ are in parallel, the total capacitance, $C_{TOTAL}$, experienced by resonator 402 is simply $C_{RT}+C_{RH}=C_{TOTAL}$.

By way of example, let us assume that the tuning plate in the conventional dielectric resonator circuit shown in FIG. 4 has a diameter of 17 mm and that the dielectric resonator has a diameter of 60 mm. Accordingly, $$\begin{aligned} C_{RT} &= k\varepsilon_0 A/d = 1(8.854*10^{-12}\ \text{F/m})\pi r^2/d \\ &= 1(8.854*10^{-12}\ \text{F/m})\pi(8.5*10^{-3}\ \text{m})^2/(5.1*10^{-3}\ \text{m}) \\ &= 0.394\ \text{Pico Farads (pF)} \end{aligned}$$

and $$\begin{aligned} C_{RH} &= k\varepsilon_0 A/d = 1(8.854*10^{-12}\ \text{F/m})\pi(r_{DR}-r_{TE})^2/d \\ &= 1(8.854*10^{-12}\ \text{F/m})\pi((30-8.5)*10^{-3}\ \text{m})^2/(9.6*10^{-3}\ \text{m}) \\ &= 2.398\ \text{Pico Farads (pF)} \end{aligned}$$

hence $$C_{TOTAL} = 0.394\ \text{pF} + 2.398\ \text{pF} = 2.792\ \text{pF}$$

Turning now to FIG. 5, employing a tuning plate 501 in accordance with the present invention, the total parasitic capacitance experienced by the dielectric resonator still is affected by $C_{RT}$ and $C_{RH}$, but is now also affected by $C_{TE}$. $C_{RT}$ and $C_{TE}$ are essentially series capacitances, and that series capacitance is in parallel with $C_{RH}$. Accordingly, the total capacitance experienced by this dielectric resonator, as dictated by this day equations, is $C_{RH}+(C_{RT}*C_{TE})/(C_{RT}+C_{TE})=C_{TOTAL}$.

Let us assume that we wish to design a filter in accordance with the principles of the present invention where the total capacitance is the same capacitance as in the example described above in connection with FIG. 4. Let us also assume that we wish to maintain the same size tuning plates and we wish to have some reasonable tuning range. We can build a filter with the same dimensions and the same size tuning plate, but replacing the metal tuning plate with a tuning plate in accordance with the present invention as described above in connection, for example, with FIG. 3. By moving the resonator slightly closer to the housing wall we can increase $C_{RH}$ slightly. Finally, let us further assume that we wish to set a $C_{RH}$ of 2.6 pF, a $C_{RT}$ of 0.4 pF and a $C_{TE}$ that can be adjusted between 0.2 pF and 0.6 pF.

In order to set $C_{RH}$ to 2.6 pF, using the equation $$C_{RH}=k\epsilon_0 A/d$$

we get $$C_{RH}=(8.854\ \text{pF/m})\pi(r_{DR}-r_{TE}).$$

Therefore, if we set d=8.85 mm, then $C_{RH}=2.6$ pF

Setting $C_{RT}$ $$\begin{aligned} C_{RT} &= k\varepsilon_0 A/d \\ &= (8.854\ \text{pF/m})\pi r_{TE}) \end{aligned}$$

Therefore, if we set d=5.0 mm, then $C_{RT}=0.4$ pF

Selecting a standard varactor diode (MA46H1200) which has a tuning range of 0.2 pF to 0.8 pF, we can calculate $C_{TOTAL}$ as follows $$C_{TOTAL}=C_{RH}+(C_{RT}*C_{TE})/(C_{RT}+C_{TE})$$

Figure 6:
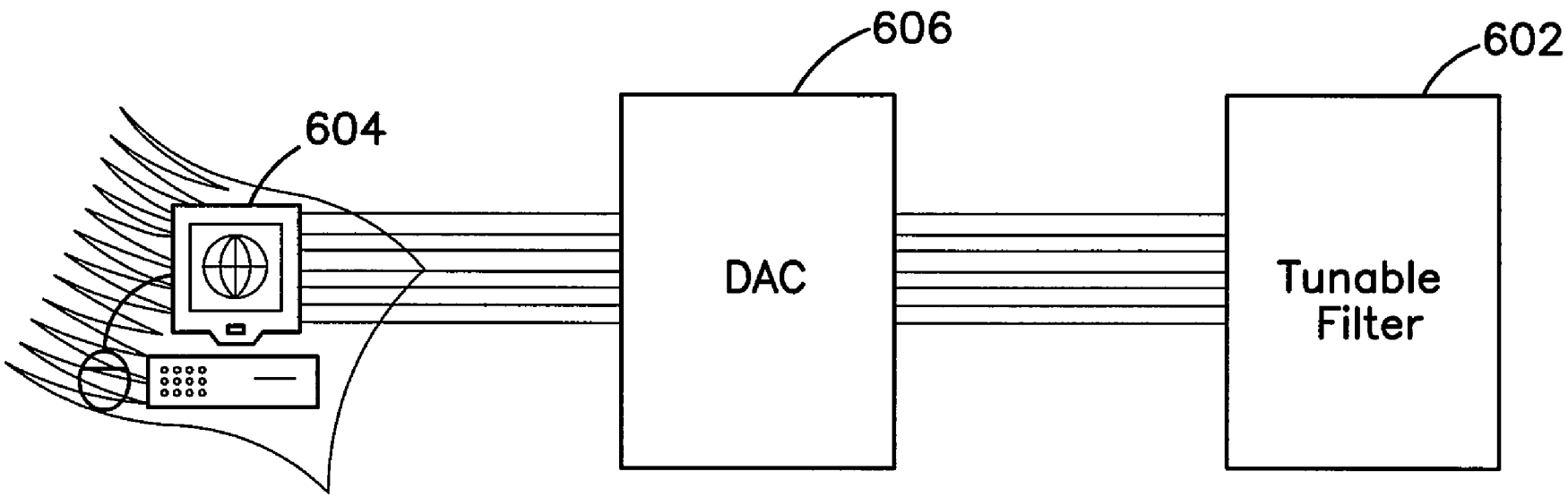
FIG. 6 is a block diagram illustrating the basic components of the present invention.

For the varactor diode biased to the minimum capacitance of 0.2 pF, $C_{TOTAL}=2.73$ pF For the varactor diode biased to the maximum capacitance of 0.8 pF, $C_{TOTAL}=2.87$ pF FIG. 6 is a block diagram illustrating the basic components of an overall tunable filter system. The tunable filter, such as the tunable filter illustrated by FIG. 3 is shown at 602. A control circuit 604, such as a computer, microprocessor, state machine, digital processor, analog circuit, or the like, controls a digital-to-analog converter 606 that provides a selected voltage and/or current to the electronic tuning element in the tunable filter 602.

Figure 8:
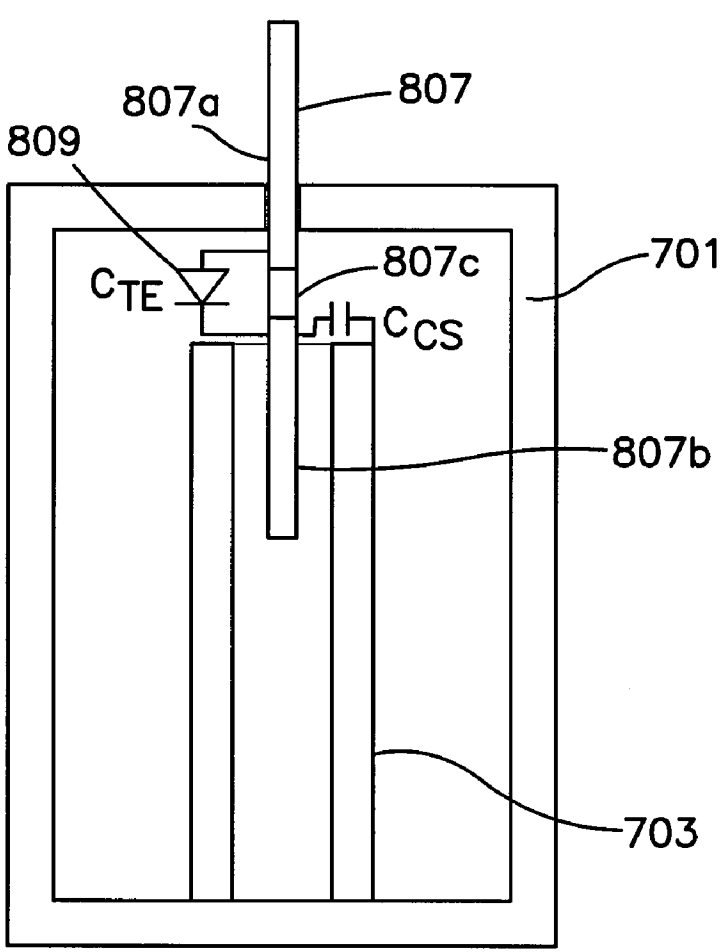
FIG. 8 is a schematic drawing illustrating the total capacitance in a combline filter in accordance with an embodiment of the present invention.
Figure 7:
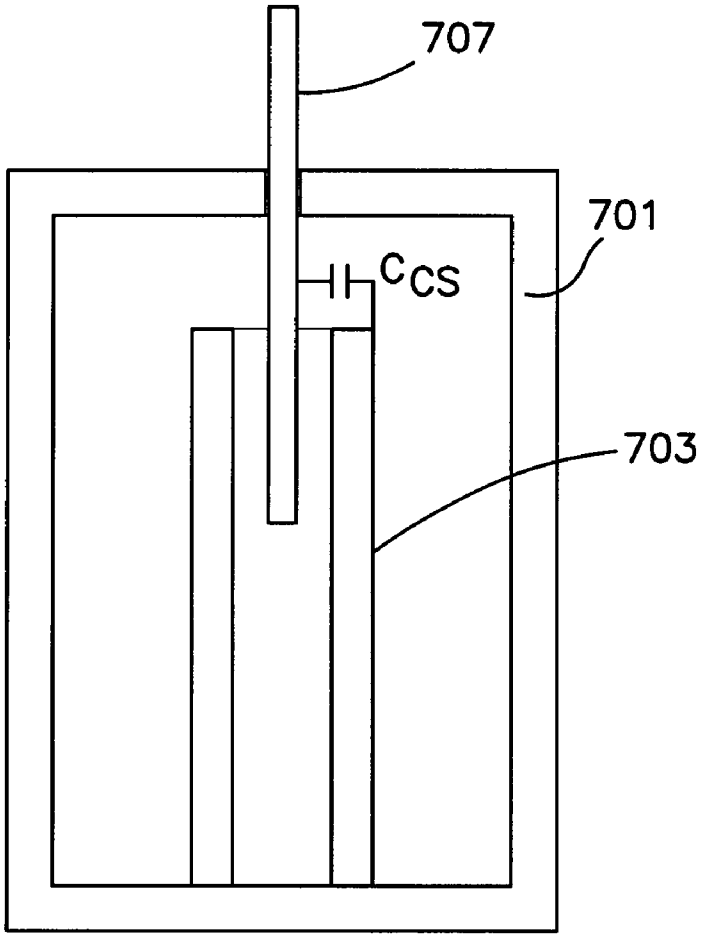
FIG. 7 PRIOR ART
FIG. 7 is a schematic drawing illustrating the total capacitance in a combline filter in accordance with the prior art.

The invention can also be applied to a combline filter to change its center frequency, as illustrated in FIGS. 7 and 8. FIG. 7 illustrates a conventional combline filter and tuning mechanism in accordance with the prior art. The combline filter comprises a housing 701 and a combline resonator 703. The resonator 703 generally is in the shape of a hollow cylinder. A metal tuning screw 707 is positioned adjacent the combline resonator 703 so as to extend into the hollow portion of the resonator 703. The tuning screw is adjustably mounted to the housing so that it can be used to adjust the frequency of the combline filter by the traditional mechanical means of moving the tuning screw 707 along its longitudinal axis so as to vary the amount of metal between the two elements in order to change the parasitic capacitance $C_{CS}$ therebetween.

FIG. 8 illustrates a combline filter similar to the one illustrated in FIG. 7, but incorporating the principles of the present invention. Elements that are essentially unchanged from the prior art are labeled with the same reference numerals and will not be discussed further. In this embodiment, the tuning screw 807 is made of a dielectric material, such as plastic. It is plated with a conductive material, such as metal, over its entire length except for a small longitudinal portion in the middle. Accordingly, the tuning screw can be considered to comprises three longitudinal segments, namely a first plated segment 807*a,* and second plated segment 807*b,* and an unplated segment 807*c.* A varactor diode or other tuning device 809 having an adjustable capacitance $C_{TE}$ is coupled between the two plated segments 807*a,* 807*b* across the gap 807*c.*

In one preferred embodiment of the invention, the tuning screw 807 is hollow and the tuning device 809 is positioned inside of the tuning screw. The principle and operation is essentially the same as described above with respect to the dielectric resonator embodiment disclosed in connection with FIGS. 3 and 5. The capacitance $C_{TE}$ of the electronic tuning device 809 and the parasitic capacitance $C_{CS}$ between the combline elements 703 and the tuning screw 807 are in series with each other. That series capacitance is, further, in parallel with any parasitic capacitance between the combline elements and the enclosure (not shown).

Figure 9:
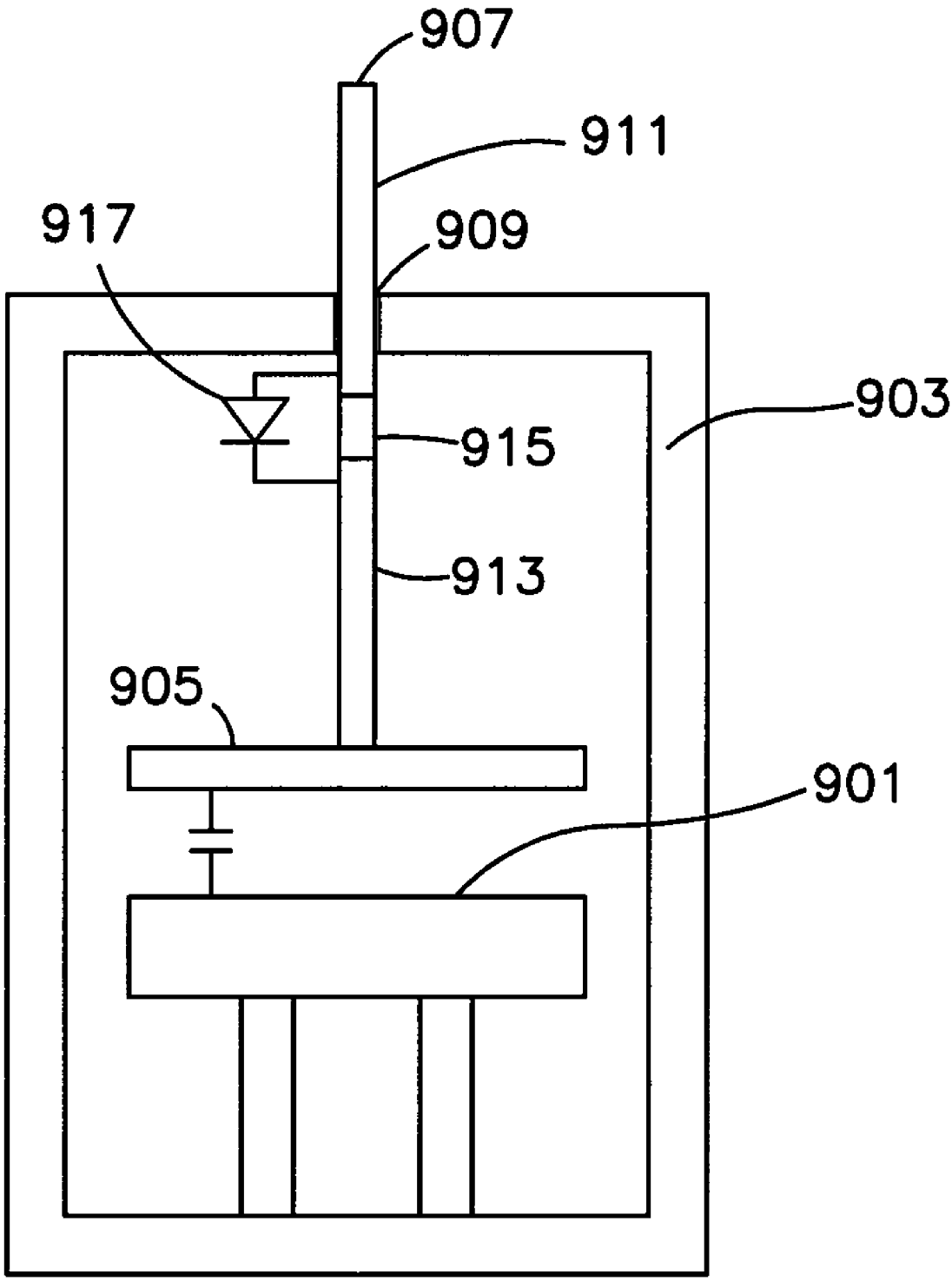
FIG. 9 is a schematic drawing illustrating another dielectric resonator circuit embodying the principles of the present invention.

FIG. 9 illustrates another embodiment of the invention. This is another dielectric resonator embodiment. In this embodiment, one or more dielectric resonators 901 are mounted in an enclosure 903. One or more tuning plates 905 are adjustably mounted to the housing such as via a threaded mounting screw 907 that can be moved up and down by rotating it in a matingly threaded hole 909 in the housing. This provides conventional mechanical tuning possibilities. In addition, at least the mounting screw 907 and, preferably, also the tuning plate 905 are formed of plastic with two distinct metallizations 911, 913 plated thereon with a gap 915 therebetween. A tuning device 917 as previously described is coupled across the two metallizations. The principles of operation are essentially the same as previously discussed in this specification.

Having thus described a few particular embodiments of the invention, various other alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example, and not limiting. The invention is limited only as defined in the following claims and equivalents thereto.

We claim:

1. A microwave filter circuit comprising:

a housing; and at least one resonator for storing electromagnetic waves;

an input coupler for coupling energy into said resonator;

an output coupler for coupling energy out of said resonator;

a tuning element positioned adjacent said resonator such that there is a parasitic capacitance between said resonator and said tuning element that will affect the frequency of said circuit, said tuning element comprising first and second distinct conductive portions and an electronic device coupled between said first and second conductive portions, said electronic device having a capacitance that varies as a function of an electrical signal input to said electronic device.

2. The circuit of claim 1 wherein said electronic device comprises a varactor diode.

3. The circuit of claim 1 wherein said electronic device comprises a PIN diode further comprising a variable voltage source for generating said control signal.

4. The circuit of claim 1 wherein said housing comprises a conductive housing surrounding at least said resonator.

5. The circuit of claim 1 wherein said at least one resonator comprises a combline element.

6. The dielectric resonator circuit of claim 5 wherein said tuning element comprises a post adjustably mounted to said housing so as to permit said post to be moved relative to said combline element, said post formed of a dielectric material and bearing a first metallization along a first longitudinal portion thereof, a second metallization along a second longitudinal portion thereof, said first and second metallizations separated by a nonconductive gap therebetween, and wherein said electronic device is electrically coupled between said first and second metallizations across said gap.

7. The dielectric resonator circuit of claim 6 wherein said electronic device is disposed within said post.

8. The circuit of claim 1 wherein said electronic device has a first terminal coupled to said first conductive portion and a second terminal coupled to said second conductive portion and wherein said control signal is coupled to one of said first and second terminals of said electronic device.

9. The circuit of claim 8 wherein said first portion of said tuning element is conductively coupled to said housing and said second portion of said tuning element is electrically coupled to said housing only through said electronic device.

10. The circuit of claim 9 wherein said control signal is coupled to said electronic device through said housing.

11. The circuit of claim 10 wherein said electronic device comprises a varactor diode, said circuit further comprising a variable voltage source for generating said control signal.

12. The circuit of claim 1 wherein said resonator comprises a dielectric resonator.

13. The circuit of claim 12 wherein said dielectric resonator comprises a plurality of dielectric resonators.

14. The circuit of claim 12 wherein said tuning element comprises a plate mounted on a post, said post adjustably mounted to said housing so as to permit said plate to be moved relative to said dielectric resonator, said post formed of a dielectric material and bearing a first metallization along a first longitudinal portion thereof, a second metallization along a second longitudinal portion thereof, said first and second metallizations separated by a nonconductive gap therebetween, and wherein said electronic device is electrically coupled between said first and second metallizations across said gap.

15. The circuit of claim 14 wherein said electronic device is disposed within said post.

16. The circuit of claim 12 wherein said tuning element comprises a tuning plate having a first surface adjacent said dielectric resonator and an opposing surface, said tuning plate further having a longitudinal through hole and wherein said second portion comprises said first surface of said tuning plate.

17. The circuit of claim 16 wherein said second portion further comprises said through hole and a central portion of said opposing surface of said tuning plate.

18. The circuit of claim 16 wherein said tuning plate further comprises a threaded radial surface and said housing comprises a matingly threaded hole within which said tuning plate is rotatably mounted so as to be movable relative to said dielectric resonator and wherein said first portion of said tuning plate comprises at least a portion of said threaded radial surface that contacts said housing via said matingly threaded hole in said housing.

19. The circuit of claim 18 wherein said tuning plate is formed of a dielectric material and first and second metallizations on said dielectric material, said first and second metallizations forming said first and second portions.

20. The circuit of claim 19 wherein said second metallization further covers at least a portion of said through hole and said second surface.

21. The circuit of claim 20 wherein said electronic device is coupled between said first and second metallizations across said second surface of said plate.

* * * * *